US012514327B2

(12) United States Patent
De Luca

(10) Patent No.: US 12,514,327 B2
(45) Date of Patent: Jan. 6, 2026

(54) BOOT FOR A MOTORCYCLIST

(71) Applicant: PIAGGIO & C. SPA, Pontedera (IT)

(72) Inventor: Marco De Luca, Pontedera (IT)

(73) Assignee: PIAGGIO & C. SPA, Pontedera (IT)

( * ) Notice: Subject to any disclaimer, the term of this patent is extended or adjusted under 35 U.S.C. 154(b) by 0 days.

(21) Appl. No.: 18/288,117

(22) PCT Filed: Mar. 22, 2022

(86) PCT No.: PCT/IB2022/052585
§ 371 (c)(1),
(2) Date: Oct. 24, 2023

(87) PCT Pub. No.: WO2022/229726
PCT Pub. Date: Nov. 3, 2022

(65) Prior Publication Data

US 2024/0197029 A1 Jun. 20, 2024

(30) Foreign Application Priority Data

Apr. 30, 2021 (IT) ..... 102021000011051

(51) Int. Cl.
*A43B 5/14* (2006.01)
*A43B 3/00* (2022.01)
(Continued)

(52) U.S. Cl.
CPC ..... *A43B 5/145* (2013.01); *A43B 3/0036* (2013.01); *A43B 5/18* (2013.01); *A43B 13/148* (2013.01)

(58) Field of Classification Search
CPC ..... A43B 5/145; A43B 3/0036; A43B 13/148; A43B 5/18
See application file for complete search history.

(56) References Cited

U.S. PATENT DOCUMENTS 1,907,856 A * 5/1933 Murphy ..... A43B 1/10 12/142 E
3,514,877 A * 6/1970 Coppola ..... A43B 1/0036 36/109

(Continued)

FOREIGN PATENT DOCUMENTS

| | | | |
|---|---|---|---|
| EP | 1625800 | A2 | 2/2006 |
| FR | 2221093 | A1 | 10/1974 |
| WO | 2012052413 | A1 | 4/2012 |

OTHER PUBLICATIONS

International Search Report for corresponding application PCT/IB2022/052585 filed Mar. 22, 2022; Mail date Apr. 12, 2022.

(Continued)

*Primary Examiner* — Khoa D Huynh
*Assistant Examiner* — Erick I Lopez
(74) *Attorney, Agent, or Firm* — CANTOR COLBURN LLP

(57) ABSTRACT

A boot for a motorcyclist, including an upper portion integrally connected to an outsole, the upper portion having a leg portion and a foot portion integrally connected to each other by means of an ankle portion, the leg portion including a shin portion and a calf portion, and the foot portion having a heel portion and a vamp portion, and a curved coverture configured to cover an outer side of the leg portion of the boot, the curved coverture being shaped according to an airfoil and including a leading edge arranged in correspondence of the shin portion and a trailing edge arranged in correspondence of the calf portion.

9 Claims, 6 Drawing Sheets

(51) Int. Cl.
*A43B 5/18* (2006.01)
*A43B 13/14* (2006.01)

(56) References Cited

U.S. PATENT DOCUMENTS

| | | | | |
|---|---|---|---|---|
| 5,371,903 | A * | 12/1994 | Lew | A41D 13/00 2/88 |
| 2011/0056095 | A1* | 3/2011 | Torrance | A43B 3/24 36/114 |
| 2015/0033585 | A1* | 2/2015 | Otus | A43B 3/0031 36/109 |
| 2017/0208894 | A1 | 7/2017 | Sanderson et al. | |
| 2018/0146744 | A1* | 5/2018 | Guest | A43B 13/148 |

OTHER PUBLICATIONS

Written Opinion for corresponding application PCT/IB2022/052585 filed Mar. 22, 2022; Mail date Apr. 12, 2022.

* cited by examiner

BOOT FOR A MOTORCYCLIST

TECHNOLOGICAL FIELD

The present invention relates to a boot for a motorcyclist, in particular a boot for motorcycle races.

BACKGROUND ART

It is known from the prior art that the aerodynamic efficiency of the rider-motorcycle assembly is one of the features affecting performance during a motorcycle race. In this regard, several solutions associated with the rider's clothing are known for obtaining certain aerodynamic effects.

An example is described in patent WO2012052413A1, which discloses a boot provided with a plurality of flaps, arranged on the inner side of the boot, for improving the braking effect of the vehicle when the rider spreads a leg to take a bend.

A further solution is described in patent EP1625800B1, which discloses a plurality of deflectors which are applicable to a motorcyclist's suit. These deflectors are attached to the motorcyclist's suit and not to the boot, thus solving the problem of modifying the aerodynamic response of the suit and not of the boots.

The boots are the element worn by the rider which is in the most retracted position with respect to the other garments (suit, helmet, etc.) and often the boots are not adequately protected by the motorcycle body, thus being partially or totally exposed to air when driving, providing a negative contribution to the drag. For these reasons, the boots have a greater impact on whether or not the fluid streamline flowing over the fairing and thus over the rider is closed. The shape of the boot can modify the aerodynamic profile of the rider-motorcycle assembly during a race, in particular when the rider is crouched, on a straight section, and the vehicle is at maximum power/speed.

There is no boot from the prior art which is capable of improving the aerodynamic properties of the rider-motorcycle assembly under racing or high-speed conditions.

SUMMARY

The aforesaid drawbacks of the prior art are now solved by a boot for a motorcyclist comprising an upper portion integrally connected to an outsole, in which the upper portion comprises a leg portion and a foot portion integrally connected to each other by means of an ankle portion; in which the leg portion in turn comprises a shin portion and a calf portion; and in which the foot portion in turn comprises a heel portion and a vamp portion. The boot further comprises a curved coverture configured to cover an outer side of the leg portion of the boot. Said curved coverture being shaped according to an airfoil and comprising a leading edge arranged in correspondence of the shin portion and a trailing edge arranged in correspondence of the calf portion. This shape of the boot allows avoiding detachments of the fluid streamline from the rider-motorcycle assembly. Thereby, the aerodynamic properties are improved as compared to conventional motorcycle boots. Moreover, turbulences at the tail of the rider-motorcycle assembly are reduced.

Preferably, the curved coverture can also cover the ankle portion. Thereby, the surface is greater and the aerodynamic losses are further reduced.

Advantageously, the curved coverture can be attached to the outer surface of the boot. This also allows pre-existing boots to be modified.

In particular, the curved coverture can comprise fixing means for attaching the curved coverture to the boot. This solution allows a simple attachment/detachment of the curved coverture to/from the boot. Preferably, said fixing means comprise laces or snap fasteners. These means provide a quick, simple and affordable coupling system of the curved coverture. Alternatively, the curved coverture can be an integral part of a covering to be worn over a conventional boot.

Alternatively, the curved coverture can be embedded in the boot. Thereby, the connection between the curved coverture and the boot is optimized and the risk of air passing between the curved coverture and the outer side of the boot is eliminated.

In particular, the curved coverture can lie under an outer layer of the boot, said outer layer preferably being a leather layer. Thereby, the boot maintains a traditional appearance, although it has an optimized aerodynamic profile. The use of a leather layer can contribute to the resistance of the boot during a possible fall.

Advantageously, the trailing edge of the curved coverture can define a sharp edge with the calf portion. This shape of the boot allows containing the longitudinal length of the boot, and thus improving the wearability thereof and the rider's freedom of movement.

Preferably, said curved coverture is smooth and can have a lower surface roughness than the average surface roughness of the rest of the upper portion of the boot. In essence, the roughness of the curved coverture is lower than that of the rest of the boot, excluding the outsole, thus reducing the aerodynamic resistance of the most exposed portion when the motorcycle travels at a high speed.

Preferably, said curved coverture can define an ogival profile arranged at said shin portion. This ogival profile allows reducing the detachment of the fluid streamline which meets the boot from the fairing, thus reducing or eliminating the turbulences in front of the boot.

Advantageously, the vamp portion can also comprise a second curved coverture to improve the aerodynamic resistance of the foot portion of the boot.

These and other advantages of will appear in more detail from the following description of an embodiment thereof, given by way of a non-limiting, indicative example, with reference to the accompanying drawings.

DETAILED DESCRIPTION

Figure 1:
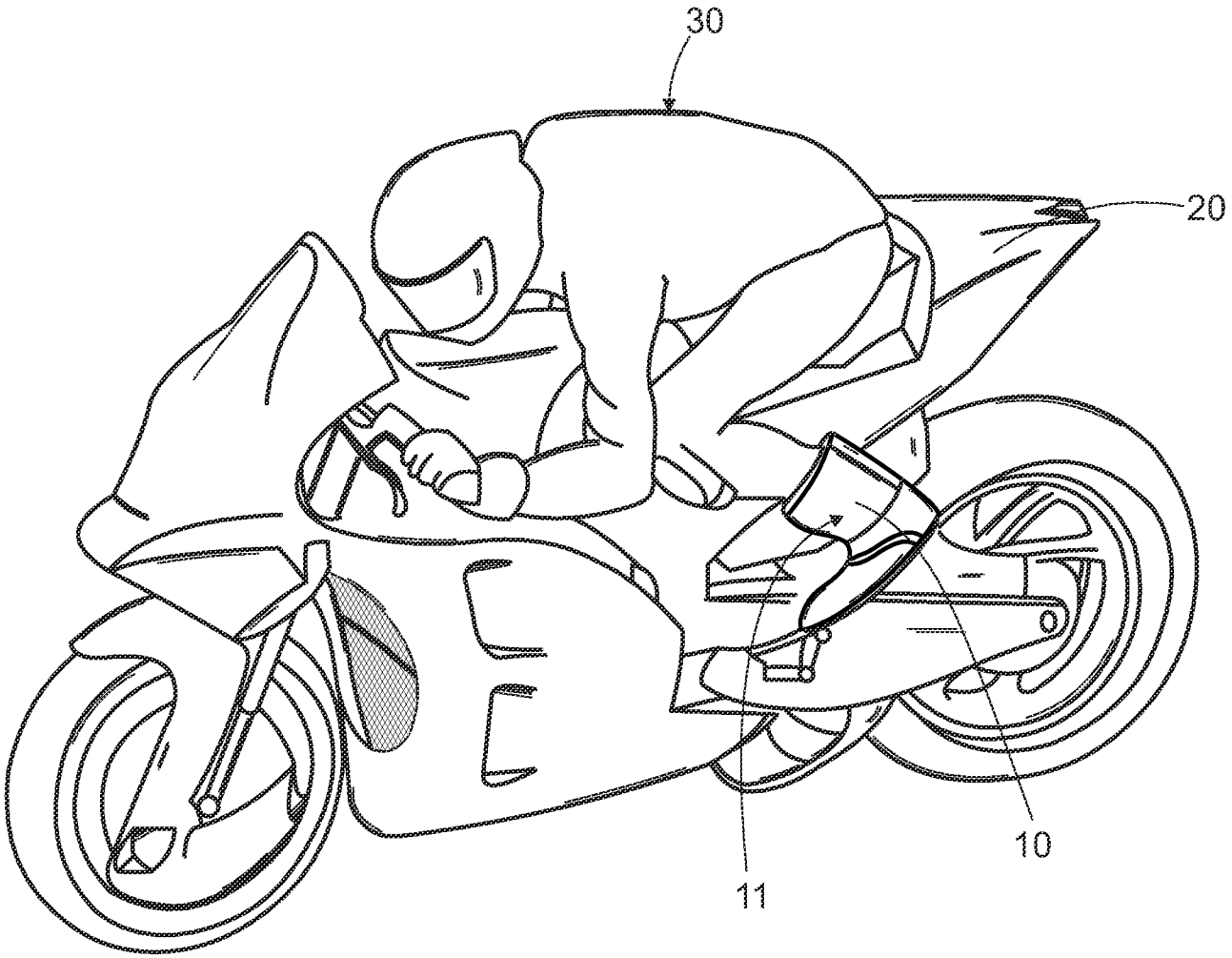
FIG. 1 shows an axonometric view of a rider-motorcycle assembly, in which the rider is wearing a pair of boots according to the present invention.

The following description of one or more embodiments of the invention relates to the accompanying drawings. The same reference numerals in the drawings identify equal or similar elements. The subject of the invention is defined by the appended claims. The technical details, structures or features of the solutions described below can be mutually combined in any manner.

With reference to FIG. 1, a motorcycle 20 is shown, on which a motorcyclist 30 is in the conventional crouched position taken by riders when traveling at high speed. In this position, typically taken on the straight sections of a race track, the aerodynamics of the rider-motorcycle assembly 20, 30 is fundamental for performance in terms of possible maximum speed, for consumption optimization and rider comfort.

The present invention aims to improve the aerodynamics of the rider-motorcycle assembly 20, 30 by means of a boot 10 provided with a curved coverture 11, as better shown in FIGS. 2-9.

With reference to the following description, the term "outer side" means the side of the boot not facing the other boot. To be clear, in the boot 10 related to the left foot of motorcyclist 30 shown in FIGS. 3-6, the outer side is the left side, and by difference, the inner side is the right one.

Figure 2:
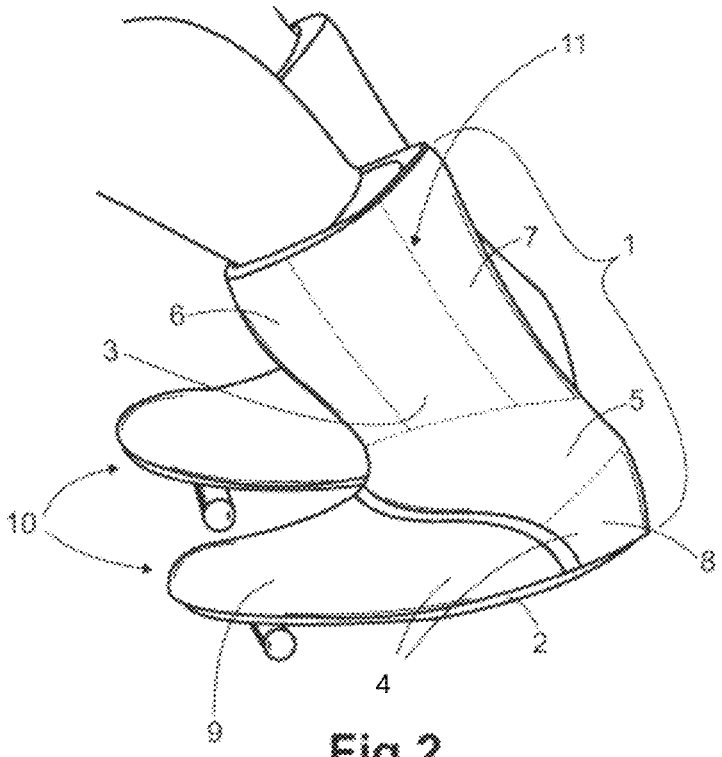
FIG. 2 shows an axonometric view of a pair of boots according to the present invention.

With reference to FIG. 2, the boot 10 comprises an upper portion 1 and an outsole 2 integrally connected to each other.

The upper portion 1 is further divided into a leg portion 3, a foot portion 4, an ankle portion 5. The ankle portion 5 connects the leg portion 3 to the foot portion 4.

Moreover, the leg portion 3 comprises a shin portion 6 and a calf portion 7, while the foot portion 4 comprises a heel portion 8 and a vamp portion 9.

The shin 6, calf 7, foot 4, ankle 5, heel 8 and leg 3 portions refer to the corresponding parts of the human body. For example, the heel portion 8 of boot 10 is meant to be that lying at the heel of motorcyclist 30 when the boot 10 is worn. For reasons of brevity, all other correspondences with the related portions of the boot are not listed, since they are intuitive in light of the example mentioned above.

The curved coverture 11 preferably covers the outer side of the leg portion 3, as shown in FIG. 1. Alternatively, and to have a greater deflecting effect, coverture 11 can also cover the ankle portion 5 or the ankle portion 5 and the heel portion 8, as shown in FIGS. 2-6.

The curved coverture 11 preferably is a semi-rigid, bulge-shaped plate.

The outer surface of this semi-rigid plate preferably is smooth, having a surface roughness less than 50 μm.

Figure 9:
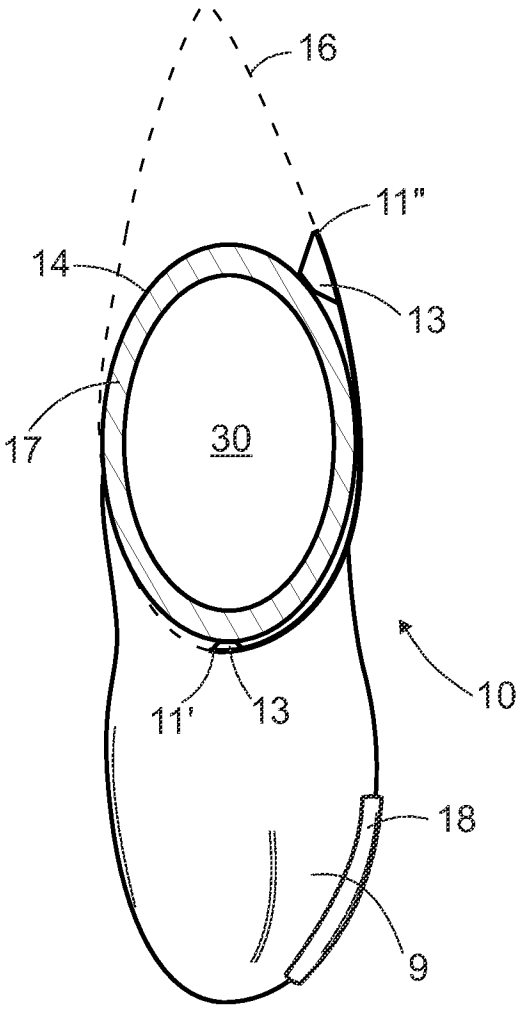
FIG. 9 shows a diagrammatic sectional top view of a boot according to a second embodiment of the present invention.
Figure 8:
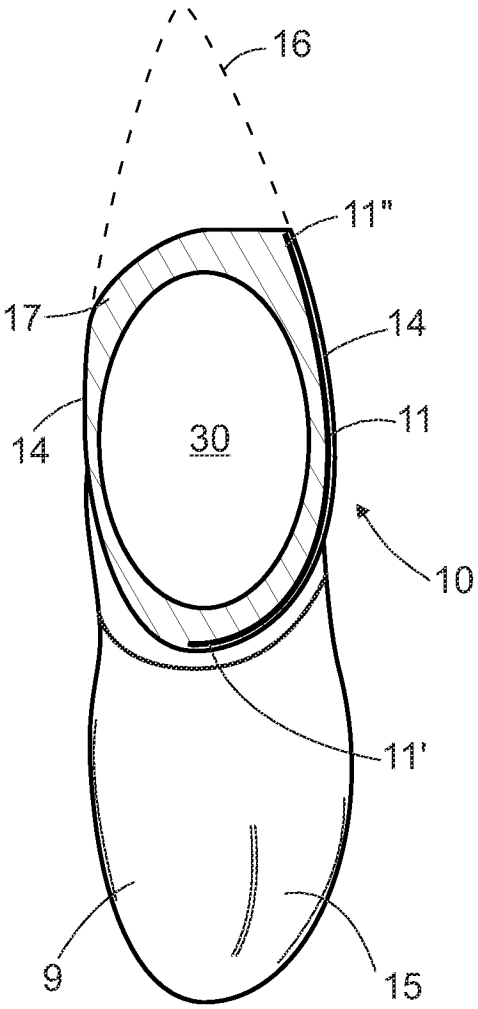
FIG. 8 shows a diagrammatic sectional top view of a boot according to a third embodiment of the present invention.
Figure 7:
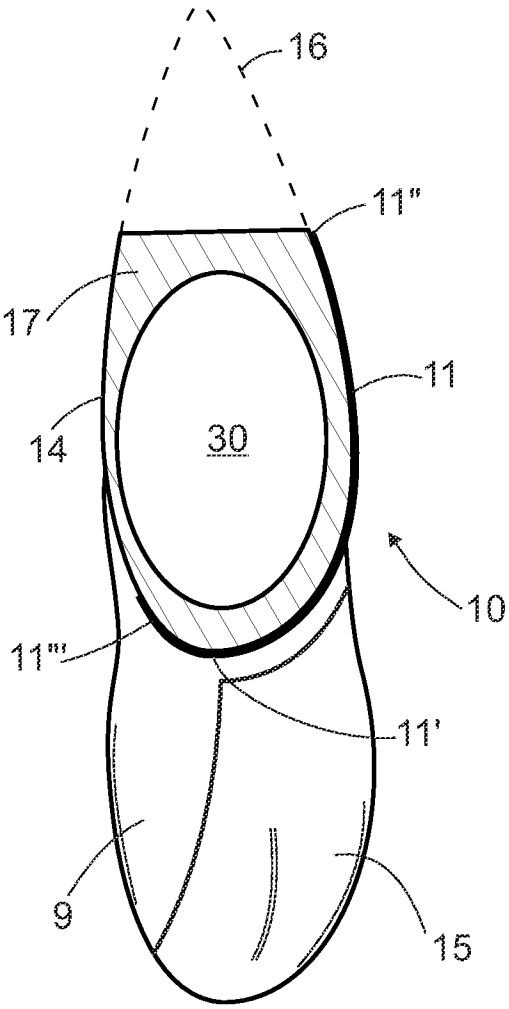
FIG. 7 shows a diagrammatic sectional top view of a boot according to a first embodiment of the present invention.

The bulge of the plate is more noticeable in FIGS. 7-9, which show a section at mid-height of the leg portion 3 of boot 10.

It can be perceived that the bulge of the plate in these sections generates a coverture 11 with a "J"-like shape.

The bulge is a simple curvature which extends over the entire height of the curved coverture 11.

The semi-rigid plate is preferably made of polymer material. Even more preferably, thermoplastic polymers, such as thermoformed PVC.

The front and rear ends of coverture 11 are the leading edge 11' and the trailing edge 11', respectively, of an airfoil depicted in FIGS. 7-9.

A complete airfoil 16 is shown with a dashed line in FIGS. 7-9. The airfoil provided by the curved coverture 11 only partially takes up the ideal surface of a complete airfoil 16, otherwise the boot would be too long at the back, thus creating mobility drawbacks and side effects during driving. The rear end could indeed create a sail effect such as to cause an excessive torsion of the rider's leg, especially when steering the motorcycle 20.

The airfoil shape of coverture 11 allows limiting or eliminating the detachment of the fluid streamline at boot 10.

Moreover, the connection of coverture 11 with boot 10 stabilizes the aerodynamic profile, despite the thrust applied by the air lapping it. This factor significantly contributes to the aerodynamic performance of the rider-motorcycle assembly 20, 30.

With reference to FIGS. 3, 4, 5, 7, a first embodiment of boot 10 is shown. In this embodiment, coverture 11 is applied to the outer side of the boot and is monolithically connected thereto.

The coverture 11 is connected to the outer side of the boot by means of an intermediate adhesive layer. Alternatively, coverture 11 can be directly sewn to boot 10. Therefore, the coverture 11 can be seen from the outside.

Since the curved coverture 11 is a smooth plate, the surface opposes less aerodynamic resistance to air than the rest of boot 10, in particular than the inner side of the leg portion 3.

Coverture 11 extends from the front to the back of the leg portion 3 of boot 10.

In particular, it almost entirely surrounds the shin portion 6, thus defining an ogival profile 11''', shown in FIG. 7. Coverture 11 further defines the leading edge 11' and the trailing edge 11''.

As shown in FIG. 7, boot 10 comprises a padding 17 and an outer layer 14 for covering the padding 17.

Padding 17 is shaped so as to form a curvilinear shape at the front and squared at the back. The outer layer 14, usually made of leather, covers the leg portion 3 of boot 10, except for coverture 11.

Vice versa, in the third embodiment shown in FIG. 8, the coverture 11 is arranged between the padding 17 and the outer layer 14. In essence, coverture 11 cannot be seen from the outside, since it is covered by the outer layer 14. This allows for an aesthetic uniformity of boot 10. Here, the surface roughness of the leg portion 3 of boot 10 is uniform because the outer layer 14 entirely surrounds the leg portion 3.

As shown in FIG. 8, coverture 11 is shaped in a similar manner to that of the first embodiment, but without the ogival profile 11'''. In particular, the coverture 11 extends from the leading edge 11' to the trailing edge 11''.

Figure 4:
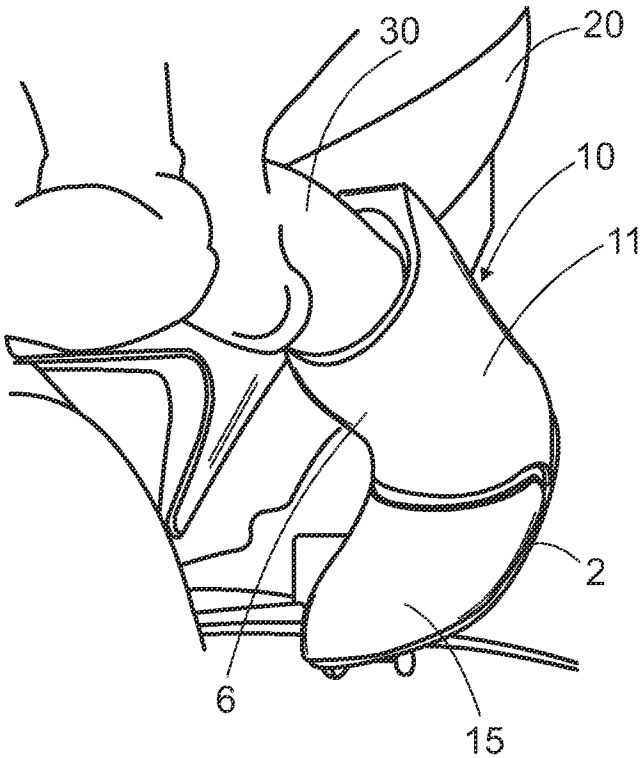
FIG. 4 shows a front-side view of a first embodiment of the boot according to the present invention.
Figure 3:
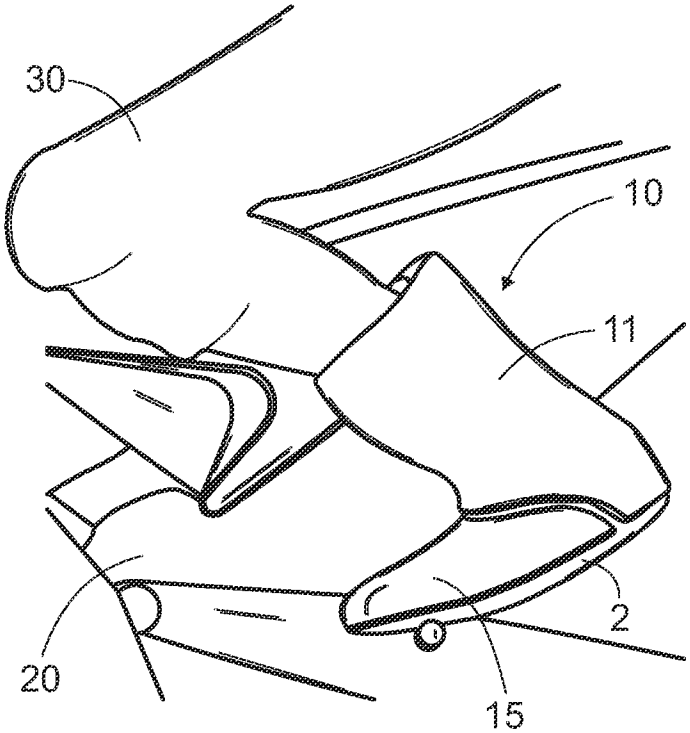
FIG. 3 shows a side view of a first embodiment of the boot according to the present invention.
Figure 5:
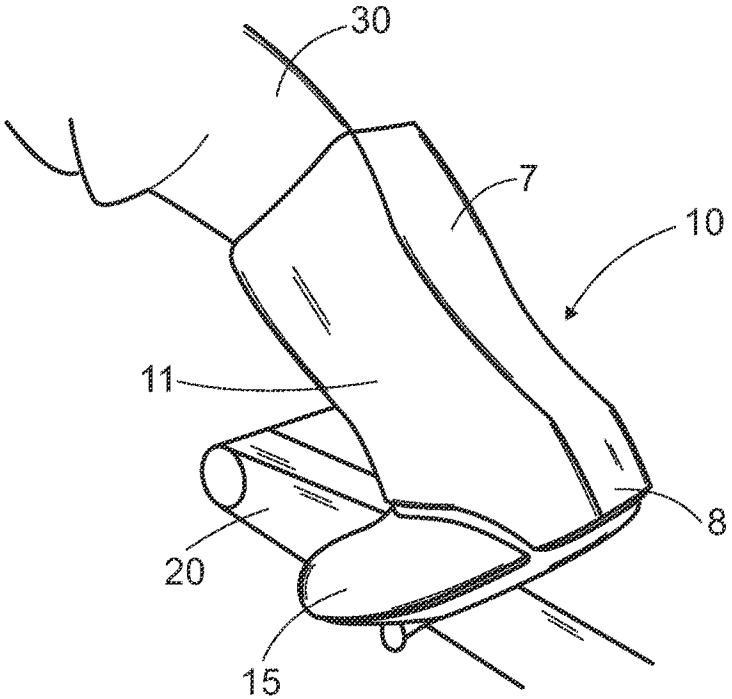
FIG. 5 shows a rear-side view of a first embodiment of the boot according to the present invention.

The third embodiment, similarly to the first one, has a padding 17 shaped with a simple front curvature profile and a flat rear profile, as better shown in FIGS. 4 and 5.

In both versions, the curved coverture 11 forms a sharp edge with the rear surface of boot 10.

The sharp edge can also affect the inner side of the boot, as shown in the embodiment in FIG. 7.

Figure 6:
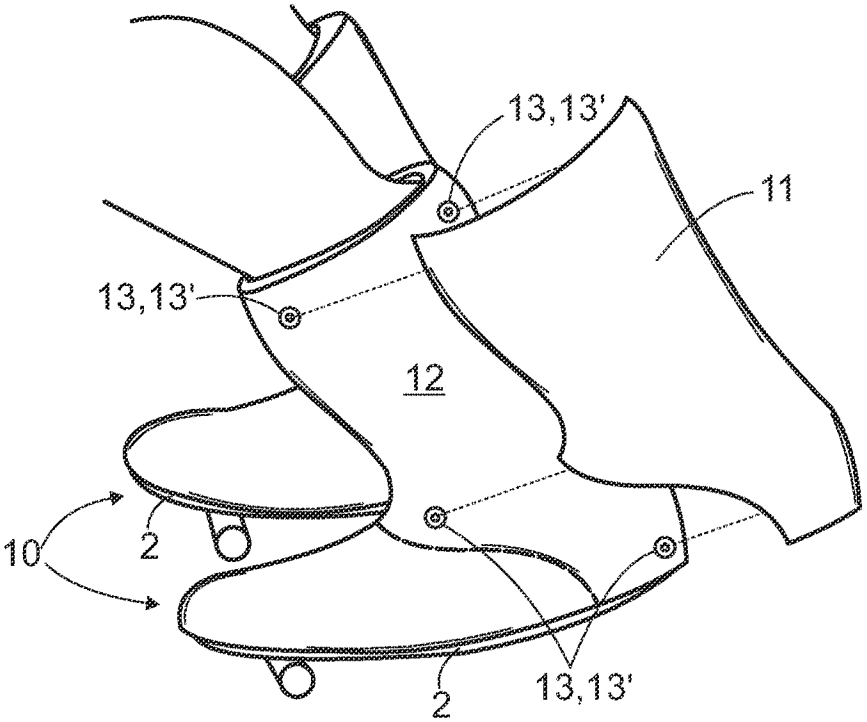
FIG. 6 shows a side view of a second embodiment of the boot according to the present invention.

The second embodiment, shown in FIGS. 6 and 9, comprises a traditional boot 10, on the outer surface 12 of which a curved coverture 11 is attached.

This curved coverture 11 is a semi-rigid plate which comprises reversible fixing means 13. Unlike the first embodiment in which coverture 11 is permanently connected to boot 10, in this embodiment coverture 11 is removable.

The fixing means can be snap fasteners, as shown in FIG. 6, or other fixing means 13, such as laces or Velcro fastening systems.

These fixing means are arranged on the inner side of coverture 11 and on the outer surface 12 of boot 10 so as to obtain said fastening when they cooperate with each other.

Preferably, the reversible fixing means 13 are configured to allow the detachment of the removable coverture 11 if the motorcyclist 30 falls, thus without altering the regulatory approval compliance of boot 10.

Preferably, the coverture 11 can be made of a clear material in order not to alter the perceived appearance of boot 10.

In this second embodiment, coverture 11 is a smooth plate which thus has a lower surface roughness than the surface roughness of the leg portion 3 of boot 10, which is made of leather, as in conventional motorcycle boots.

Figure 10:
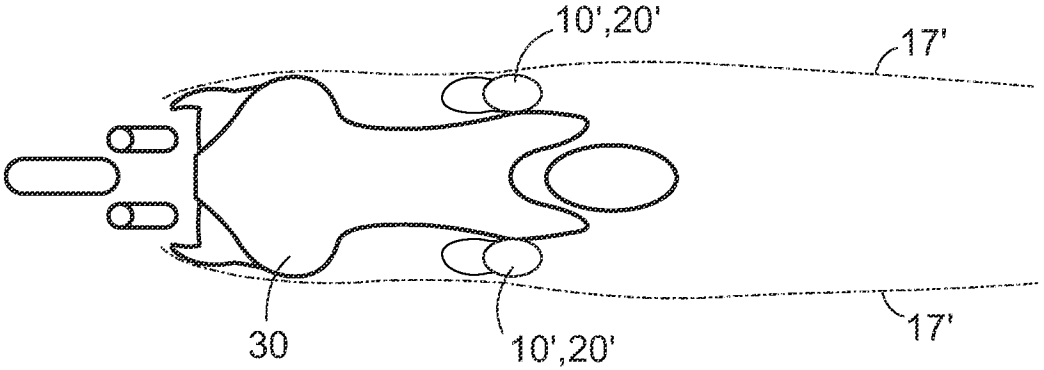
FIG. 10 shows a diagrammatic sectional top view of a rider-motorcycle assembly according to the prior art.
Figure 11:
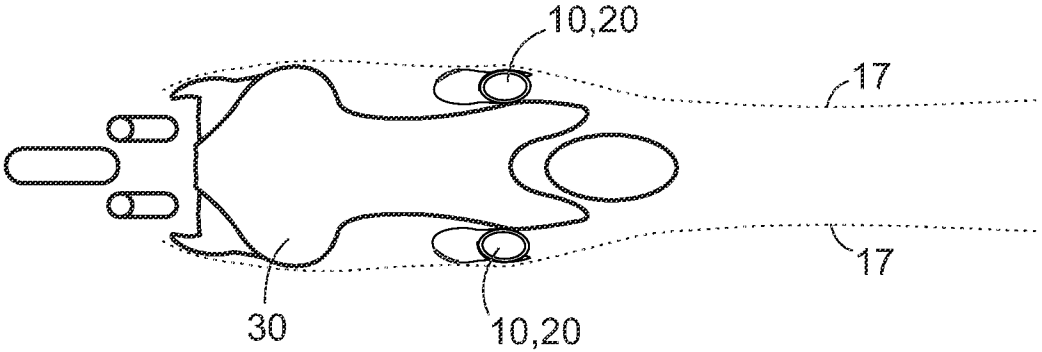
FIG. 11 shows a diagrammatic sectional top view of a rider-motorcycle assembly, in which the rider is wearing a pair of boots according to the present invention.

With reference to the embodiments described above, the shape and position of the curved coverture 15 of boot 10 allows avoiding the detachment of the fluid streamline of air lapping the rider-motorcycle assembly 20, 30, as shown in FIG. 11. This figure depicts a section of the rider-motorcycle assembly 20, 30 with a plane parallel to the ground and taken at the height of the leg portion 3. As it can be seen in FIG. 10, using known boots of the prior art, a detachment of the fluid streamline occurs from the rider-motorcycle assembly 20, 30 at the boot. This detachment of the fluid streamline generates resistance forces which increase with speed in a more than proportional manner. Therefore, this undesired effect becomes apparent at high speeds, thus limiting the speed performance and increasing consumption. Using the boots 10 according to the present invention, it was instead found, with both calculation simulations (CFD) and wind tunnel tests, that this detachment of the fluid streamline is absent or limited and the aerodynamic performance was considerably improved, as shown in FIG. 11. Moreover, by reducing the resistance provided by boot 10, the ergonomics for motorcyclist 30 also improves because his/her legs are subjected to less aerodynamic stress.

Optionally, the boot 10 of one or more of the embodiments described above can comprise a further curved coverture 15 arranged at the vamp portion 9.

The vamp portion 9, in particular the part thereof facing the outer side of boot 10, usually comprises a sacrificial element 18, in jargon referred to as a "soap bar" due to its shape. This element 18 is that usually coming into contact with the ground when the motorcyclist 30 leans over when the motorcycle 20 takes a bend. However, the strictly structural function of element 18 aerodynamically limits the performance of the rider-motorcycle assembly 20, 30.

Indeed, the protruding shape of the sacrificial element 18 is a protrusion of the vamp portion 9 which deflects the fluid streamline of air lapping the boot 10.

Therefore, it is preferable for boot 10 to comprise a second curved coverture 15 which covers the vamp portion 9 of boot 10. In addition to improving the aerodynamic performance of this portion of boot 10, this second curved coverture 15 simultaneously acts as a sacrificial element, thus avoiding the use of the conventional one.

Although the above description relates to one boot 10, it is apparent that the description is applicable to both boots 10 of a pair of boots 10.

The technical features of the three embodiments described above can be combined with one another to form further embodiments not depicted or described herein, but in any case included in the present invention. By mere way of example, the shape of the padding of the first embodiment can correspond to that of the third embodiment or vice versa, as well as the second embodiment can comprise a second curved coverture 15 like the other embodiments.

In conclusion, it is apparent that the invention thus conceived is susceptible to several modifications or variations, all falling within the invention; moreover, all details can be replaced by technically equivalent elements. In practice, the quantities can be varied according to technical needs.

The invention claimed is:

1. A boot for motorcyclist comprising:

an upper portion integrally connected to an outsole;

the upper portion comprising a leg portion and a foot portion integrally connected to each other by an ankle portion;

the leg portion comprising a shin portion and a calf portion; and the foot portion comprising a heel portion and a vamp portion; and a curved coverture configured to cover an outer side of the leg portion of the boot;

said curved coverture having a shape comprising a portion of a complete airfoil shape, the curved coverture extending from a front to a back of the leg portion of the boot and extending from the outer side of the leg portion of the boot, across the shin portion of the leg portion, and at least partially onto an inner side of the leg portion of the boot, defining an ogival profile;

wherein the coverture further defines a leading edge and a trailing edge, the leading edge being arranged proximate to the shin portion and the trailing edge being arranged proximate to the calf portion, the trailing edge of the curved coverture defines a sharp edge with the calf portion; and wherein the curved coverture is integral with the upper portion of the boot.

2. The boot according to claim 1, wherein the curved coverture also covers the ankle portion or the ankle portion and the heel portion.

3. The boot according to claim 1, wherein the curved coverture is attached to an outer surface of the boot.

4. The boot according to claim 1, wherein the curved coverture comprises fixing means to attach the curved coverture to the boot, wherein said fixing means comprise laces or snap fasteners.

5. The boot according to claim 1, wherein an outer layer of the boot is disposed over the curved coverture, said outer layer being a leather layer.

6. The boot according to claim 1, wherein said curved coverture has a surface roughness less than an average surface roughness of the leg portion of the boot.

7. The boot according to claim 1, wherein said curved coverture has a section at mid-height of the leg portion of the boot that is shaped like the letter "J".

8. The boot according to claim 1, wherein the vamp portion comprises a second curved coverture.

9. A boot for motorcyclist comprising:

an upper portion integrally connected to an outsole;

the upper portion comprising a leg portion and a foot portion integrally connected to each other by an ankle portion;

the leg portion comprising a shin portion and a calf portion; and the foot portion comprising a heel portion and a vamp portion;

wherein a curved coverture is embedded in the boot;

said curved coverture comprising a leading edge arranged over the shin portion and a trailing edge arranged over the calf portion, wherein the curved coverture extends from the leading edge to the trailing edge.

* * * * *